US006276430B1

(12) United States Patent
Wu et al.

(10) Patent No.: US 6,276,430 B1
(45) Date of Patent: Aug. 21, 2001

(54) SUNSHADE CURTAIN DEVICE

(76) Inventors: J. H. Wu; Yih-Wenn Luo, both of 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/493,538

(22) Filed: Jan. 28, 2000

(51) Int. Cl.[7] ..... A47G 5/02
(52) U.S. Cl. ..... 160/265; 160/71; 160/240
(58) Field of Search ..... 160/265, 240, 160/243, 71, 80; 135/88.1, 88.11, 88.12, 141; 49/121, 123

(56) References Cited

U.S. PATENT DOCUMENTS 160,290 * 3/1875 Trenchard .
820,214 * 5/1906 Learned ..... 160/71
1,012,239 * 12/1911 Bourne ..... 160/265
2,237,202 * 4/1941 Strattan .
5,820,088 * 10/1998 Chapman .
6,006,811 * 12/1999 Brutsaert ..... 160/71

FOREIGN PATENT DOCUMENTS

2212893 * 2/1973 (DE) ..... 160/80
2594480 * 9/1987 (FR) ..... 160/121.1

* cited by examiner

*Primary Examiner*—Blair M. Johnson

(57) ABSTRACT

A sunshade curtain device has a main shaft, a positioning device, a first movable device, a second movable device, a third movable device, a bobbin, and a rope. A curtain fabric surrounds the main shaft. The main shaft is disposed on a lower edge of a window. A lower end of the positioning device is disposed on the lower edge of the window. The first movable device engages with the positioning device. The second movable device engages with the first movable device. The third movable device engages with the second movable device.

1 Claim, 6 Drawing Sheets

SUNSHADE CURTAIN DEVICE

BACKGROUND OF THE INVENTION

The present invention relates to a sunshade curtain device. More particularly, the present invention relates to a sunshade curtain device which is assembled easily.

A sunshade curtain device has a plurality of gears to drive a curtain fabric. However, it is cumbersome to assemble the sunshade curtain device with a plurality of gears.

SUMMARY OF THE INVENTION

An object of the present invention is to provide a sunshade curtain device which can be assembled easily.

Another object of the present invention is to provide a sunshade curtain device which can be operated easily.

DETAILED DESCRIPTION OF THE INVENTION

Figure 1:
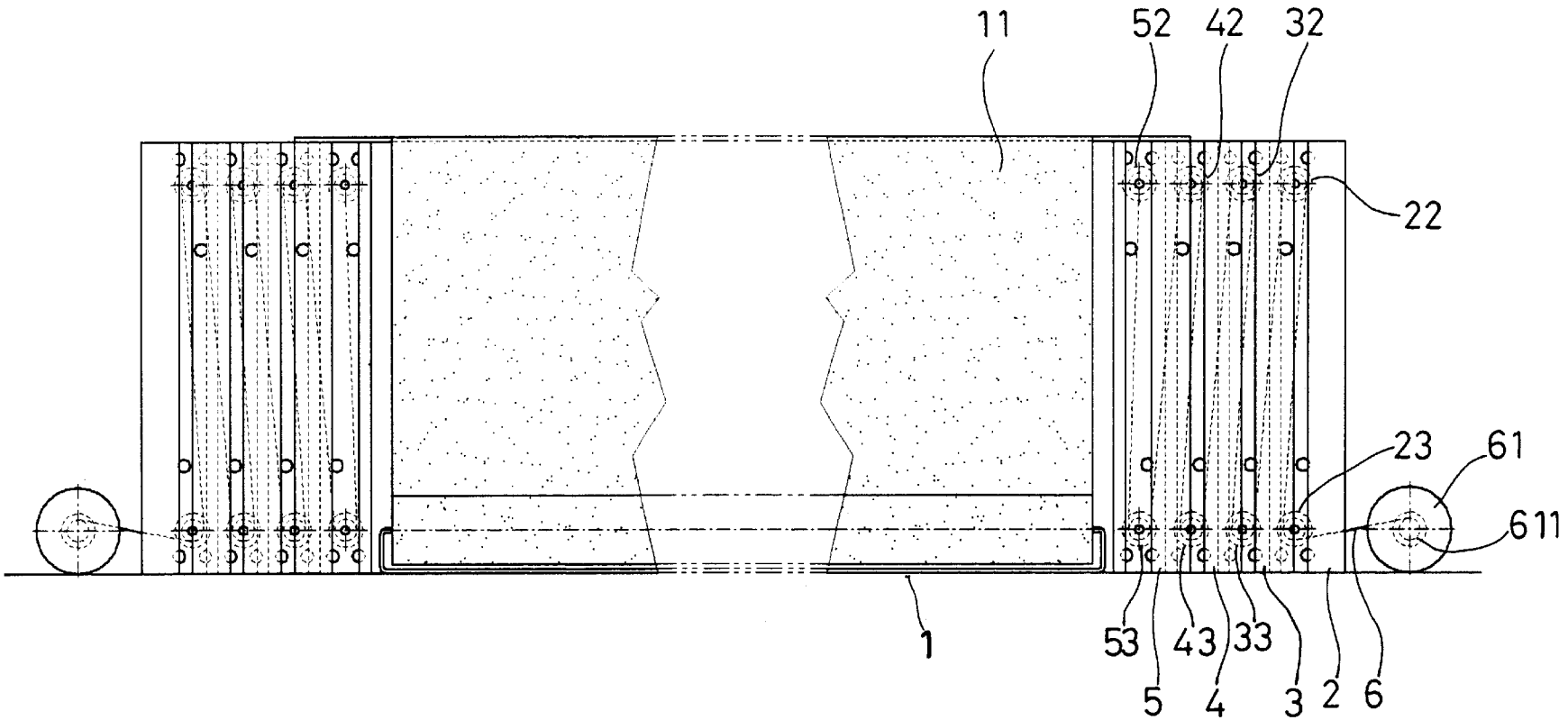
FIG. 1 is a front elevational view of a sunshade curtain device of a preferred embodiment in accordance with the present invention.
Figure 2:
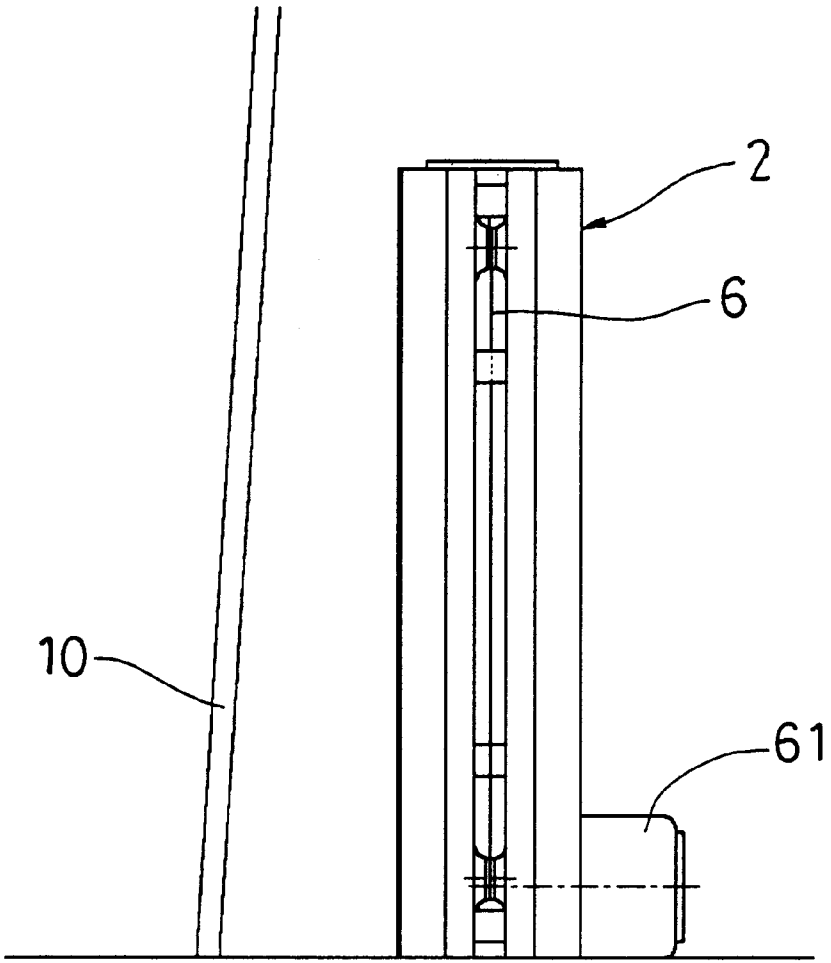
FIG. 2 is a side elevational view of a sunshade curtain device of a preferred embodiment in accordance with the present invention.
Figure 3:
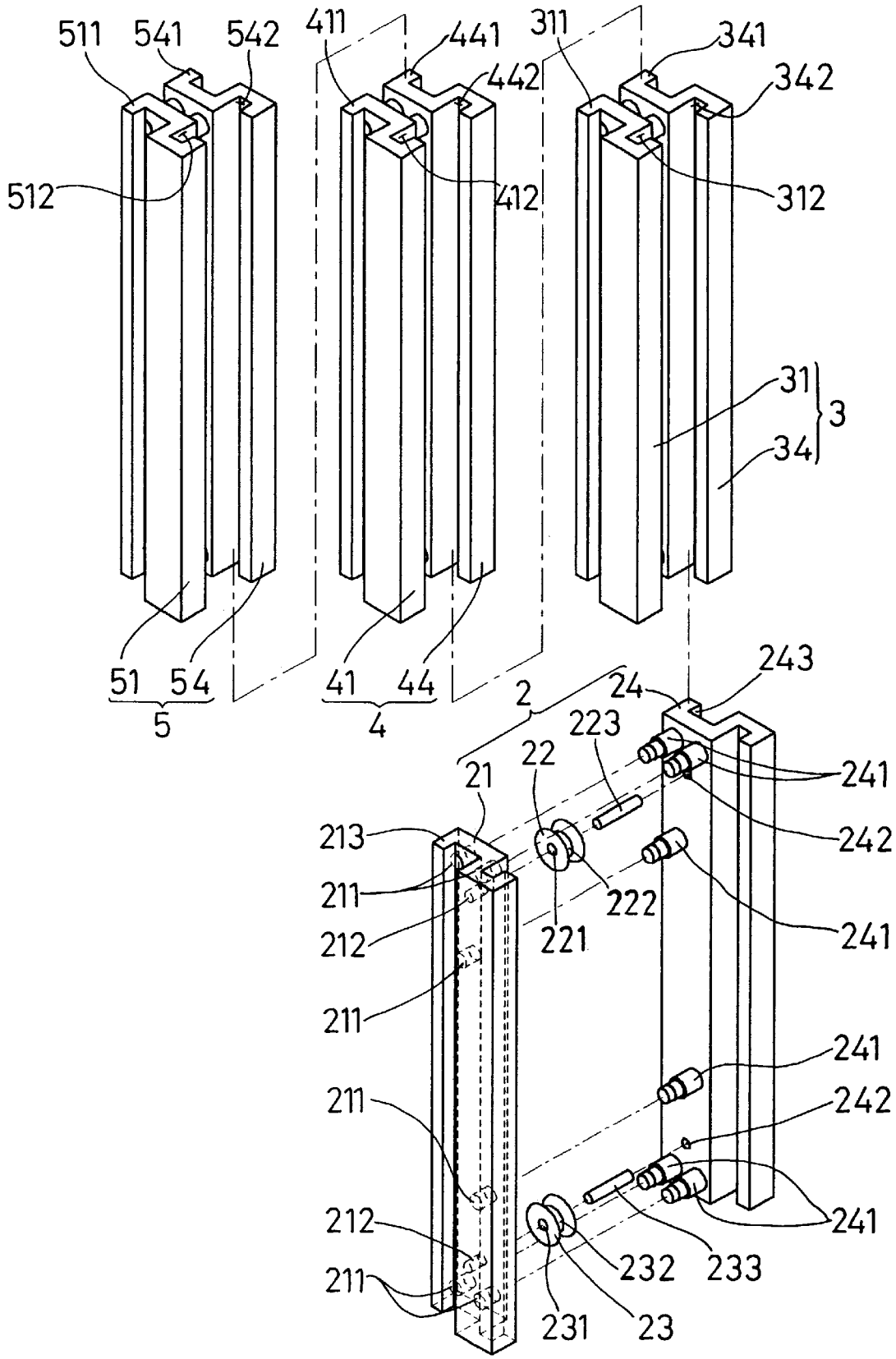
FIG. 3 is a perspective exploded view of a sunshade curtain device of a preferred embodiment in accordance with the present invention.
Figure 4:
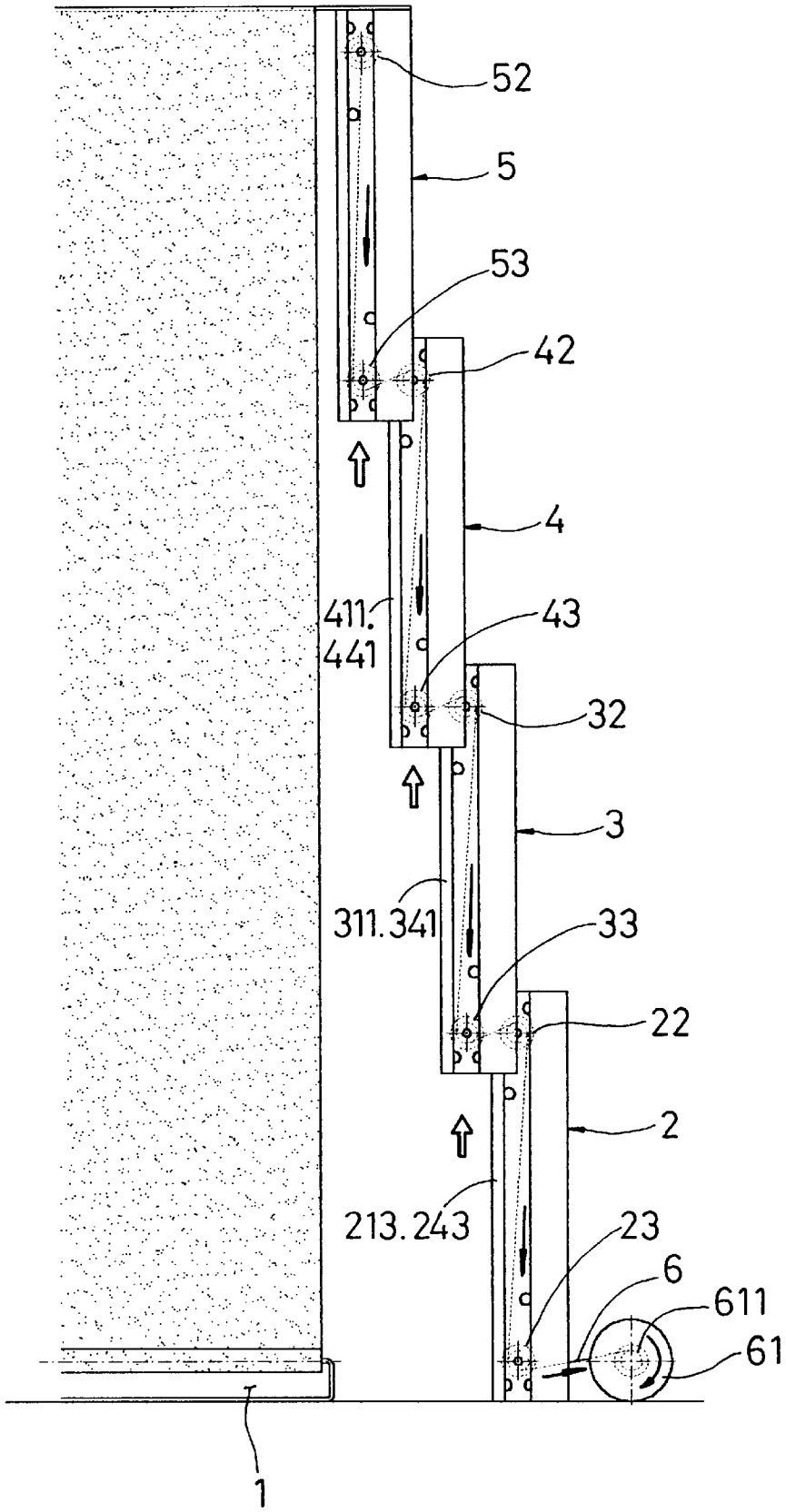
FIG. 4 is a shematic view illustrating an operation of a sunshade curtain device of a preferred embodiment in accordance with the present invention.

Referring to FIGS. 1 to 4, a sunshade curtain device comprises a main shaft 1, a positioning device 2, a first movable device 3, a second movable device 4, a third movable device 5, a bobbin 61, and a rope 6.

A curtain fabric 11 surrounds the main shaft 1.

The main shaft 1 is disposed on a lower edge of a window 10. A lower end of the positioning device 2 is disposed on the lower edge of the window 10.

The positioning device 2 has a first plate 21 having a plurality of first insertion holes 211 and two first axle holes 212, a first lower axle 233, a first upper axle 223, a second female plate 24 having a plurality of posts 241 and two first pivot holes 242, and the second plate 24 coupled with the first plate 21 by the posts 241.

The first plate 21 further has a first rail 213.

The second plate 24 further has a second rail 243.

A first lower pulley 23 has a center hole 231 and a first annular recess 232.

A first upper pulley 22 has a center aperture 221 and a first annular groove 222.

The first lower axle 233 passes through the center hole 231 of the first lower pulley 23 and is inserted in the respective first axle hole 212 and the respective first pivot hole 242.

The first upper axle 223 passes through the center aperture 221 of the first upper pulley 22 and is inserted in the respective first axle hole 212 and the respective first pivot hole 242.

The first lower pulley 23 is located in a lower portion of the positioning device 2.

The first upper pulley 22 is located in an upper portion of the positioning device 2.

The structure of the first movable device 3 is the same as the structure of the positioning device 2.

The structure of the second movable device 4 is the same as the structure of the positioning device 2.

The structure of the third movable device 5 is the same as the structure of the positioning device 2.

The first movable device 3 comprises a third plate 31 comprising a first guide groove 312 and a third rail 311 and a second female plate 34 comprising a second guide groove 342 and a fourth rail 341.

The fourth female plate 34 couples with the third plate 31.

The second movable device 4 comprises a fifth plate 41 comprising a third guide groove 412 and a sixth rail 411 and a third female plate 44 comprising a third guide groove 442 and a sixth rail 441.

The sixth plate 44 couples with the fifth plate 41.

The third movable device 5 comprises a seventh plate 51 comprising a fifth guide groove 512 and a seventh rail 511 and an eighth plate 54 comprising a sixth guide groove 542 and an eighth rail 541.

The eighth plate 54 couples with the seventh plate 51.

A second lower pulley 33 is located in a lower portion of the first movable device 3.

A second upper pulley 32 is located in an upper portion of the first movable device 3.

A third lower pulley 43 is located in a lower portion of the second movable device 4.

A third upper pulley 42 is located in an upper portion of the second movable device 4.

A fourth lower pulley 53 is located in a lower portion of the third movable device 5.

A fourth upper pulley 52 is located in an upper portion of the third movable device 5.

The rope 6 winds a bobbin shaft 611. The rope 6 surrounds the first lower pulley 23, the first upper pulley 22, the second lower pulley 33, the second upper pulley 32, the third lower pulley 43, the third upper pulley 42, the fourth lower pulley 53, and the fourth upper pulley 52.

An end of the rope 6 is disposed on the fourth upper pulley 52.

The first rail 213 is inserted in the first guide groove 312 of the first movable device 3.

The second rail 243 is inserted in the second guide groove 342 of the fourth plate 34.

The third rail 311 is inserted in the third guide groove 412 of the fifth plate 41.

The fourth rail 341 is inserted in the fourth guide groove 442 of the sixth plate 44.

The fifth rail 411 is inserted in the fifth guide groove 512 of the seventh plate 51.

The sixth rail 441 is inserted in the sixth guide groove 542 of the eighth plate 54.

An upper edge of the curtain fabric 11 is connected to an upper end of the third movable device 5.

When the bobbin shaft 611 is rotated, the rope 6 will be shortened so that the first movable device 3 will move upward along the positioning device 2. The second movable device 4 will move upward along the first movable device 3. The third movable device 5 will move upward along the second movable device 4.

Figure 5:
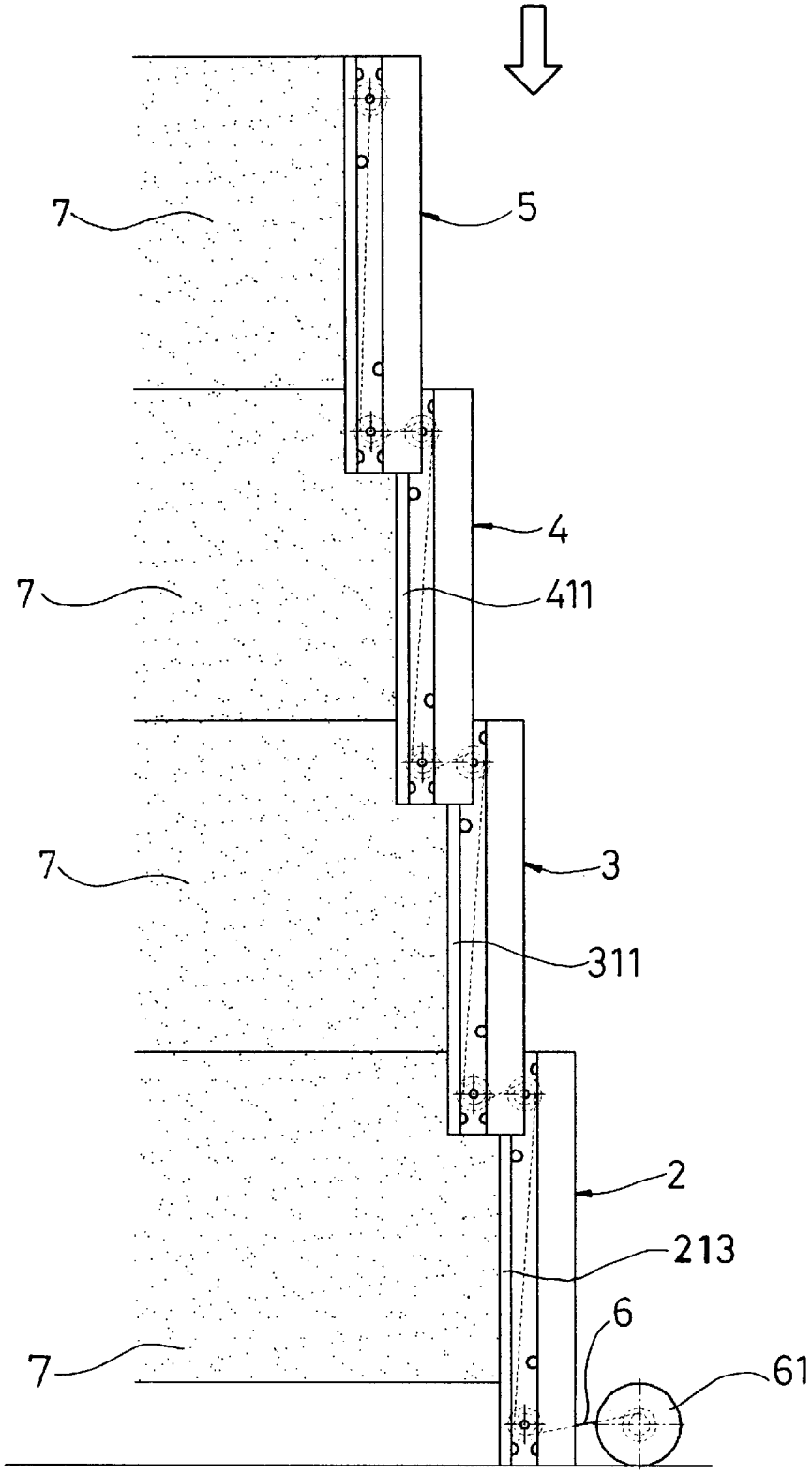
FIG. 5 is a shematic view illustrating an operation of a sunshade curtain device with a plurality of screen fabrics.
Figure 6:
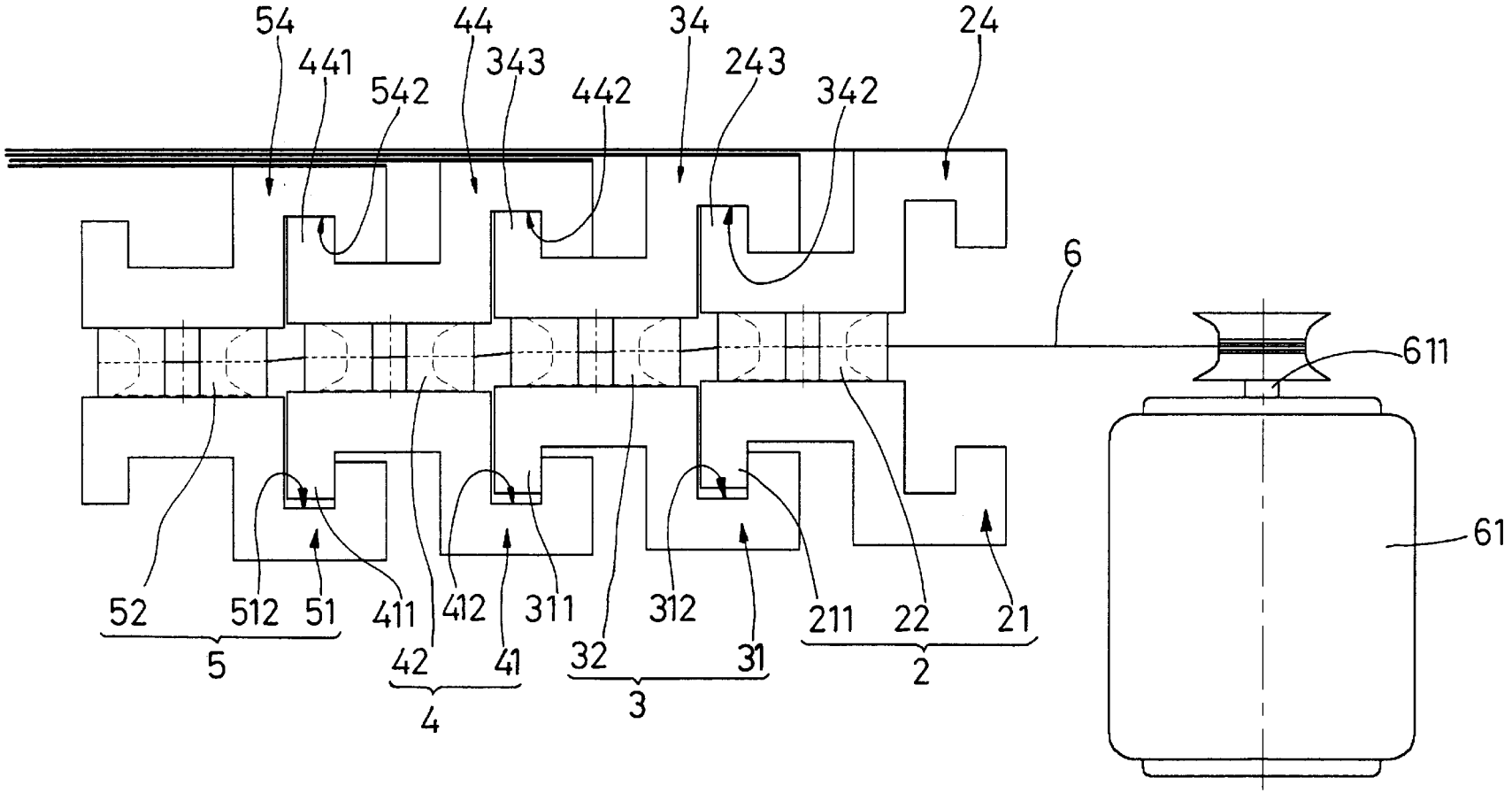
FIG. 6 is another shematic view illustrating an operation of a sunshade curtain device with a plurality of screen fabrics.

Referring to FIGS. 5 and 6, a plurality of screen fabrics 7 can replace the curtain fabric 11.

The present invention is not limited to the above embodiment but various modification thereof may be made. Furthermore, various changes in form and detail may be made without departing from the scope of the present invention.

What is claimed is:

1. A sunshade curtain device comprises:

a main shaft a positioning device, a first movable device, a second movable device, a third movable device, a bobbin, and a rope, a curtain fabric surrounds the main shaft, the main shaft adapted to be disposed on a lower edge of a window, a lower end of the positioning device adapted to be disposed on the lower edge of the window, the positioning device having a first plate having a plurality of first insertion holes and two first axle holes, a first lower axle, a first upper axle, a second plate having a plurality of posts and two first pivot holes, and the second plate coupled with the first plate by the posts, the first plate further having a first rail, the second plate further having a second rail, a first lower pulley having a center hole and a first annular recess, a first upper pulley having a center aperture and a first annular groove, the first lower axle passing through the center hole of the first lower pulley and inserted in the respective first axle hole and the respective first pivot hole, the first upper axle passing through the center aperture of the first upper pulley and inserted in the respective first axle hole and the respective first pivot hole, the first lower pulley located in a lower portion of the positioning device, the first upper pulley located in an upper portion of the positioning device, the first movable device comprising a third plate comprising a first guide groove and a third rail and a fourth plate comprising a second guide groove and a fourth rail, the fourth plate coupling with the third plate, the second movable device comprising a fifth plate comprising a third guide groove and a fifth rail and a sixth plate comprising a third guide groove and a sixth rail, the sixth plate coupling with the fifth plate, the third movable device comprising a seventh plate comprising a fifth guide groove and a seventh rail and an eighth plate comprising a sixth guide groove and an eighth rail, the eighth plate coupling with the seventh plate, a second lower pulley located in a lower portion of the first movable device, a second upper pulley located in an upper portion of the first movable device, a third lower pulley located in a lower portion of the second movable device, a third upper pulley located in an upper portion of the second movable device, a fourth lower pulley located in a lower portion of the third movable device, a fourth upper pulley located in an upper portion of the third movable device, the rope winding a bobbin shaft, the rope surrounding the first lower pulley, the first upper pulley, the second lower pulley, the second upper pulley, the third lower pulley, the third upper pulley, the fourth lower pulley, and the fourth upper pulley, the first rail inserted in the first guide groove of the first movable device, the second rail inserted in the second guide groove of the fourth plate, the third rail inserted in the third guide groove of the fifth plate, the fourth rail inserted in the fourth guide groove of the sixth plate, the fifth rail inserted in the fifth guide groove of the seventh plate, the sixth rail inserted in the sixth guide groove of the eighth plate, and an upper edge of the curtain fabric connected to an upper end of the third movable device.

* * * * *